US007600360B2

(12) United States Patent
Schroeder et al.

(10) Patent No.: US 7,600,360 B2
(45) Date of Patent: Oct. 13, 2009

(54) FLEXIBLE PACKAGING

(75) Inventors: Alfred A. Schroeder, San Antonio, TX (US); Michael T. Romanyszyn, San Antonio, TX (US)

(73) Assignee: Lancer Partnership Ltd, Dorothy Linda Schroeder as Trustee for three trusts, and SMJCGF, LLP, San Antonio, TX (US)

( * ) Notice: Subject to any disclaimer, the term of this patent is extended or adjusted under 35 U.S.C. 154(b) by 760 days.

(21) Appl. No.: 10/842,980

(22) Filed: May 11, 2004

(65) Prior Publication Data

US 2004/0206055 A1 Oct. 21, 2004

Related U.S. Application Data

(63) Continuation of application No. 10/126,702, filed on Apr. 19, 2002, now abandoned.

(51) Int. Cl.
*B65B 3/17* (2006.01)

(52) U.S. Cl. ..... 53/452; 53/133.2; 53/562; 53/455

(58) Field of Classification Search ..... 53/451–452, 53/455, 133.1, 133.2, 562, 410, 412; 493/213, 493/929

See application file for complete search history.

(56) References Cited

U.S. PATENT DOCUMENTS

| | | | | |
|---|---|---|---|---|
| 3,894,381 | A | 7/1975 | Christine | |
| 4,055,032 | A | 10/1977 | Hammond | |
| 4,246,062 | A | 1/1981 | Christine | |
| 4,341,522 | A | 7/1982 | Gaubert | |
| 4,381,846 | A | 5/1983 | Heck | |
| 4,411,359 | A | 10/1983 | Franco | |
| 4,491,247 | A | 1/1985 | Nitchman et al. | |
| 4,512,136 | A | 4/1985 | Christine | |
| 4,524,458 | A | 6/1985 | Pongrass et al. | |
| 4,566,250 | A | 1/1986 | Wakuo | |
| 4,568,321 | A | 2/1986 | Gaubert | |
| 4,598,529 | A | 7/1986 | Pongrass et al. | |
| 4,601,410 | A | 7/1986 | Bond | |
| 4,603,536 | A | 8/1986 | de la Poype | |
| 4,614,074 | A * | 9/1986 | Evers | 53/236 |
| 4,695,337 | A | 9/1987 | Christine | |
| 4,709,528 | A | 12/1987 | Merkus | |
| 4,710,157 | A | 12/1987 | Posey | |
| 4,718,215 | A | 1/1988 | Carveth | |
| 4,726,171 | A | 2/1988 | Kreager et al. | |
| 4,779,397 | A | 10/1988 | Christine | |
| 4,893,731 | A | 1/1990 | Richter | |
| 4,913,316 | A | 4/1990 | Richter | |
| 4,924,656 | A | 5/1990 | Posey | |
| 4,998,990 | A | 3/1991 | Richter | |
| 5,139,168 | A | 8/1992 | Gueret | |

(Continued)

FOREIGN PATENT DOCUMENTS

| | | |
|---|---|---|
| DE | 19714057 A1 | 10/1998 |

(Continued)

*Primary Examiner*—Christopher Harmon
(74) *Attorney, Agent, or Firm*—Dennis Braswell

(57) ABSTRACT

Methods and apparatus for forming and filling a flexible package are provided in which an evacuation device (26) and a fitment (20) are attached to a sheet of flexible material (16). The sheet of flexible material (16) is formed into a package that is filled and sealed.

2 Claims, 7 Drawing Sheets

U.S. PATENT DOCUMENTS

| | | | |
|---|---|---|---|
| 5,147,071 | A | 9/1992 | Rutter |
| 5,203,819 | A | 4/1993 | Gleason |
| 5,254,074 | A | 10/1993 | Landers |
| 5,334,180 | A | 8/1994 | Adolf |
| 5,348,525 | A | 9/1994 | Buchanan |
| 5,467,581 | A | 11/1995 | Everette |
| 5,477,883 | A | 12/1995 | Totten |
| 5,481,853 | A | 1/1996 | Nasrallah et al. |
| 5,493,845 | A | 2/1996 | Adolf |
| 5,514,123 | A | 5/1996 | Adolf |
| 5,564,591 | A | 10/1996 | Christine et al. |
| 5,566,851 | A | 10/1996 | Susaki et al. |
| 5,647,511 | A | 7/1997 | Bond |
| 5,743,435 | A | 4/1998 | Tomic |
| 5,749,493 | A | 5/1998 | Boone |
| 5,758,473 | A | 6/1998 | Patelli |
| 5,788,620 | A | 8/1998 | Aeschbach |
| 5,827,164 | A | 10/1998 | Tomic |
| 5,832,698 | A | 11/1998 | Huguein |
| 5,915,596 | A | 6/1999 | Credle |
| 5,937,617 | A | 8/1999 | Yeager |
| 5,941,421 | A | 8/1999 | Overman |
| 6,027,438 | A | 2/2000 | Frazier |
| 6,041,575 | A | 3/2000 | Vonderhorst et al. |
| 6,045,006 | A | 4/2000 | Frazier |
| 6,066,081 | A | 5/2000 | Bachner |
| 6,073,807 | A | 6/2000 | Wilford |
| 6,076,664 | A | 6/2000 | Yeager |
| 6,102,252 | A | 8/2000 | Overman |
| 6,179,173 | B1 | 1/2001 | Frazier |
| 6,205,746 | B1 | 3/2001 | Moss |
| 6,253,944 | B1 | 7/2001 | Mogard |
| 6,293,394 | B1 | 9/2001 | Marbler et al. |
| 6,354,062 | B1 | 3/2002 | Haughton et al. |
| 6,581,357 | B1 | 6/2003 | Lindenberger |
| 6,591,874 | B2 | 7/2003 | Credle, Jr. |
| 6,715,644 | B2 | 4/2004 | Wilford |
| 6,968,669 | B2 * | 11/2005 | Schroeder et al. ..... 53/410 |
| 2001/0002024 | A1 * | 5/2001 | Edwards ..... 220/705 |
| 2002/0112151 | A1 * | 8/2002 | Hill et al. ..... 713/2 |
| 2002/0113118 | A1 * | 8/2002 | Littlejohn et al. ..... 229/407 |
| 2002/0148857 | A1 | 10/2002 | Savage |

FOREIGN PATENT DOCUMENTS

| | | | |
|---|---|---|---|
| EP | 0156627 | A2 | 10/1985 |
| EP | 0251812 | A2 | 1/1988 |
| EP | 0278670 | A2 | 8/1988 |
| EP | 0216800 | B1 | 7/1990 |
| EP | 0377882 | B1 | 7/1990 |
| EP | 0589575 | A1 | 3/1994 |
| EP | 0663880 | B1 | 11/1996 |
| EP | 0688291 | B1 | 2/1997 |
| EP | 0778217 | A1 | 6/1997 |
| EP | 0695698 | B1 | 10/1997 |
| EP | 0729406 | B1 | 9/1998 |
| EP | 0713468 | B1 | 2/1999 |
| EP | 0710176 | B1 | 7/1999 |
| EP | 0596142 | B1 | 10/2000 |
| EP | 1086804 | A2 | 3/2001 |
| EP | 1094970 | B1 | 9/2002 |
| GB | 2293134 | A | 3/1996 |
| GB | 2303116 | B | 9/1999 |
| GB | 2320481 | B | 12/2000 |
| GB | 2331065 | | 1/2002 |
| JP | 09-267849 | | 10/1997 |
| WO | WO 98/22350 | | 5/1998 |
| WO | WO 99/41155 | | 8/1999 |
| WO | WO-00/23327 | | 4/2000 |
| WO | WO-00/68089 | | 11/2000 |
| WO | WO-01/39967 | A1 | 6/2001 |
| WO | WO-01/79073 | | 10/2001 |
| WO | WO-02/40553 | A1 | 5/2002 |

* cited by examiner

FIG. 5
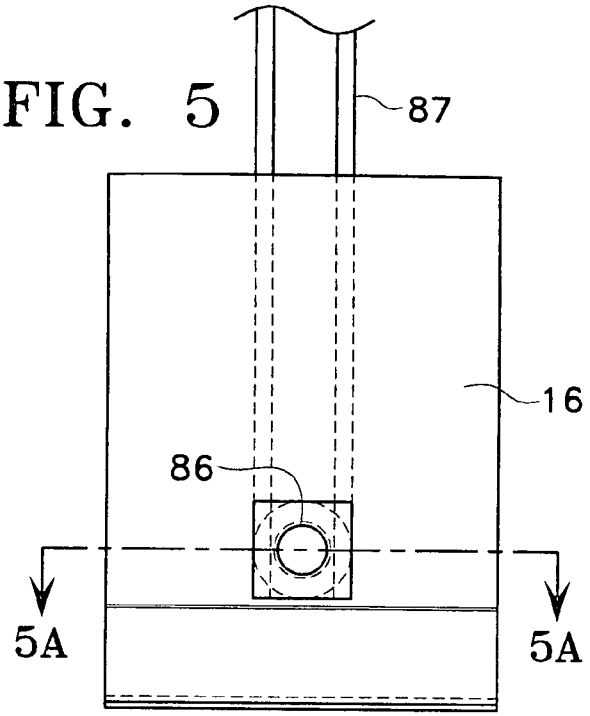
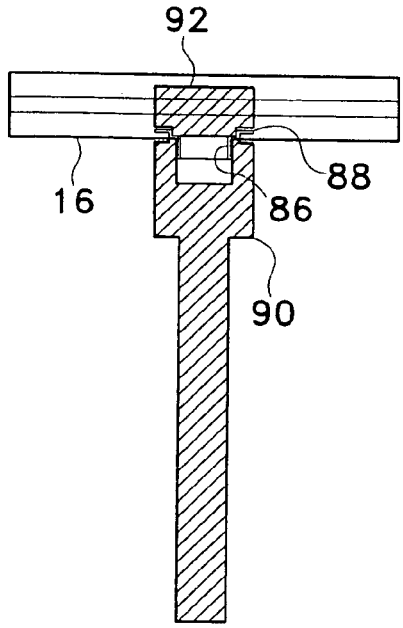
FIG. 5A
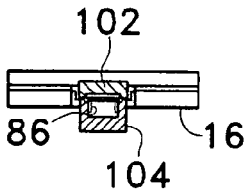
FIG. 6B
FIG. 6
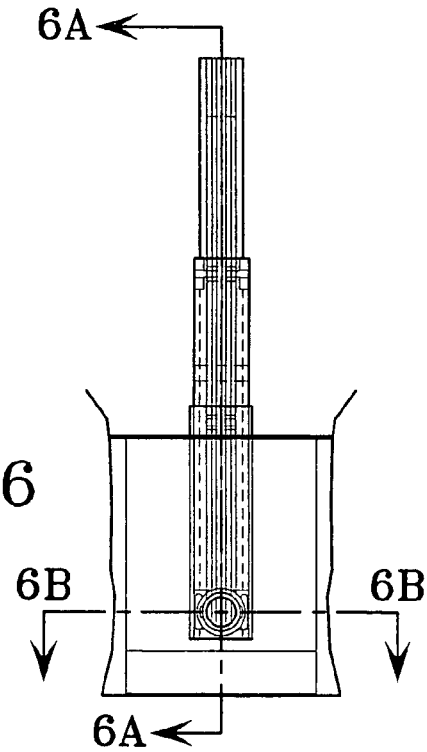
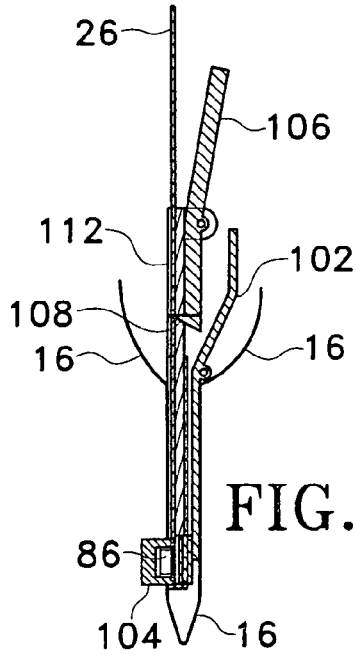
FIG. 6A

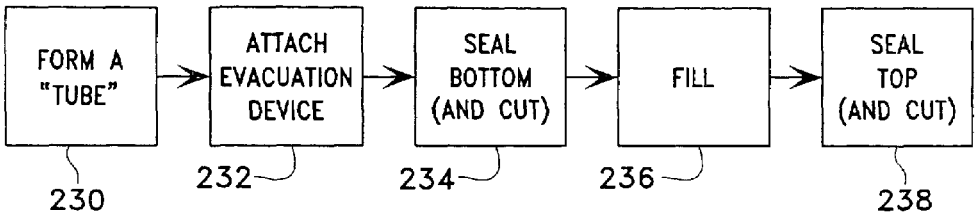
FIG. 11
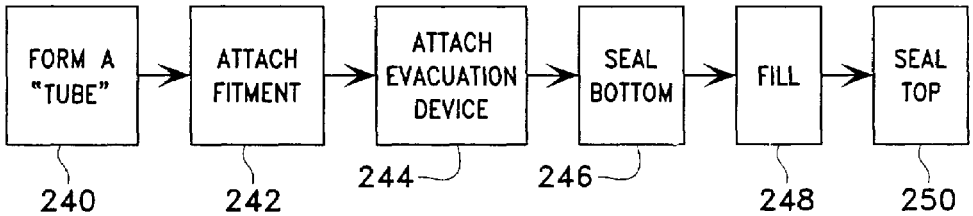
FIG. 12
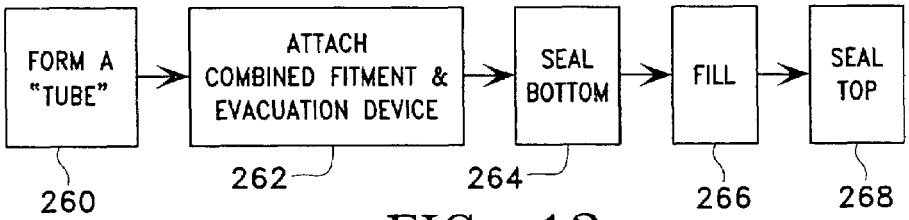
FIG. 13
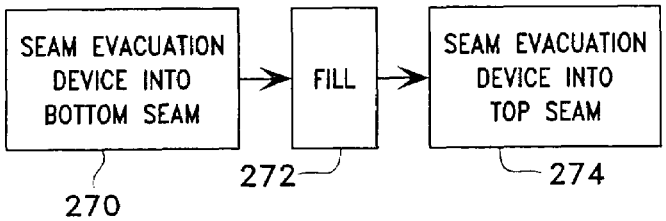
FIG. 14
FIG. 15
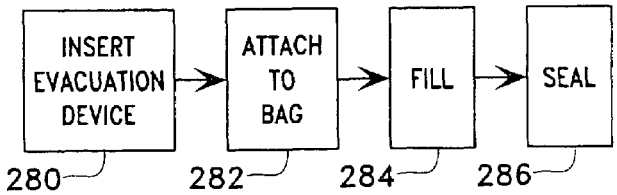

FLEXIBLE PACKAGING

This application is a continuation of U.S. patent application Ser. No. 10/126,702, filed Apr. 19, 2002, now abandoned and entitled Flexible Packaging.

TECHNICAL FIELD OF THE INVENTION

This invention relates generally to packaging, and more particularly to flexible packaging.

BACKGROUND OF THE INVENTION

The many advantages of flexible packaging have made it the package of choice in many applications. Two prominent fields for flexible packaging are the beverage industry, for example for wines or for beverage syrups, and the pharmaceutical field. Of course, many other applications exist as well.

In general, products are filled into flexible packages and then distributed for use by customers for their particular application. The products are either filled into pre-made bags through fitments, or filled into bags as the bags are being made on form, fill, and seal machines. Often the flexible packaging is distributed in boxes, and such systems are commonly referred to as bag-in-box ("BIB") systems. "Bag," as used in this disclosure, is meant to include any flexible package, including, without limitation, bags, pouches, and stand-up packages.

Significant efforts have been made at increasing the efficiency of form, fill, and seal machines, and of operations that make pre-made bags. Furthermore, there have been various developments directed at improving the evacuation efficiency of pre-made bags.

However, attempts at improving evacuation efficiency have often reduced efficiencies during the bag filling operation. For example, one approach for improving evacuation efficiency involves the use of an evacuation device known as a dip strip, which includes a base and raised ribs that create evacuation channels. For this device to work well, it must be coupled closely to the fitment through which product is evacuated from the bag. However, on pre-made bags, the proximity of the evacuation device to the fitment (which is also the filling spout) reduces the maximum flow rate that can be used to fill the bag, thus slowing down the speed of the filling operation. Also, form, fill, and seal systems have not accommodated the manufacture of bags that include evacuation devices to improve evacuation efficiencies. Therefore, a need has arisen for a system that allows for the efficiencies that result from form, fill, and seal machines, along with the evacuation efficiencies that have been allowed with pre-made bag systems.

SUMMARY OF THE INVENTION

In accordance with the teachings of the present invention, methods and apparatus for forming and filling flexible packages are provided which substantially eliminate or reduce problems associated with prior art systems.

In particular, a method of forming and filling a flexible package is provided that includes partially forming the package, attaching an evacuation device, filling the package, and sealing the package. The evacuation device may be attached before the package is partially formed or after it is partially formed. The package may be sealed by making a top seal.

In other embodiments, the following are provided, alone or together: partially forming the package by folding a sheet of flexible material; partially forming the package by forming side seals; and forming the side seals on a horizontal form, fill, and seal machine.

In still other embodiments, the following are provided, alone or together: partially forming the package by forming a tube from a sheet of flexible material; partially forming the package by forming a bottom seal; and forming the bottom seal on a vertical form, fill, and seal machine.

In another embodiment, a fitment is attached to the flexible package. One method of attaching the fitment includes coupling the evacuation device and the fitment, and attaching the evacuation device comprises attaching the coupled evacuation device and fitment. In one embodiment, the fitment is attached to an inside surface of the flexible package, and does not penetrate the flexible package. In another, the fitment penetrates the flexible package. In one method, a hole is formed for receiving the fitment. The fitment may comprise any suitable access device, and in a particular embodiment, without limitation, is a port that includes a valve.

In another embodiment, the fitment is attached before attaching the evacuation device, and the evacuation device is attached proximate the fitment. In a particular embodiment, the evacuation device is attached to the fitment.

The evacuation device may be attached in many different ways and places, and, for example, may be attached to an inside surface of the flexible package, or seamed into a seal of the flexible package. Without limitation, the evacuation device may be a dip strip.

Another method of the present invention includes attaching a fitment to a sheet of flexible material, attaching an evacuation device proximate the fitment, partially forming the package from the sheet of flexible material, filling the package, and sealing the package. The fitment may be attached before the package is partially formed, or after it is partially formed. Sealing the package may comprise making a top seal.

In a particular embodiment of this method, partially forming the package comprises folding the sheet of flexible material. Also, partially forming the package may comprise forming side seals. The side seals may be formed on a horizontal form, fill, and seal machine.

In anther embodiment of this method, partially forming the package comprises forming a tube from the sheet of flexible material. Also, partially forming the package may comprise forming a bottom seal. The bottom seal may be formed on a vertical form, fill, and seal machine.

In another embodiment, the evacuation device and the fitment are coupled, and attaching the fitment and attaching the evacuation device comprise attaching the coupled evacuation device and fitment. In one embodiment, the fitment may be attached to an inside surface of the flexible package, and does not penetrate the flexible package. In another, the fitment penetrates the sheet of flexible material. A hole may be made in the flexible material for receiving the fitment. The fitment may comprise any suitable access device, and in a particular embodiment, without limitation, is a port that includes a valve.

In another embodiment, the fitment is attached before attaching the evacuation device, and the evacuation device is attached proximate the fitment. In a particular embodiment, the evacuation device is attached to the fitment.

The evacuation device may be attached in many different ways and places, and, for example, may be attached to an inside surface of the flexible package, or seamed into a seal of the flexible package. Without limitation, the evacuation device may be a dip strip.

Also provided is apparatus for carrying out the methods described herein.

An important technical advantage of the present invention is that an evacuation device is included as part of a flexible package on form, fill, and seal machines of any kind, including horizontal and vertical machines. Another important technical advantage of the present invention is that a fitment and an evacuation device may be attached to a flexible package during a form, fill, and seal operation, and may be attached as separate units or as a combined or integrally formed unit.

BRIEF DESCRIPTION OF THE DRAWINGS

Reference is made in description to the following briefly described drawings, wherein like reference numerals refer to corresponding elements:

FIG. 5 illustrates a particular embodiment of a fitment attaching station according to the teachings of the present invention;

FIG. 5A illustrates a cross section of the fitment attaching station of FIG. 5, taken along line 5A of FIG. 5;

FIG. 6 illustrates a particular embodiment of an evacuation device attaching station according to the teachings of the present invention;

FIG. 6A illustrates a cross section of the evacuation device attaching station of FIG. 6, taken along line 6A of FIG. 6;

FIG. 6B illustrates a cross section of the evacuation device attaching station of FIG. 6, taken along fine 6B of FIG. 6;

FIG. 11 illustrates a block diagram of a particular embodiment of a method according to the teachings of the present invention;

FIG. 12 illustrates a block diagram of another embodiment of a method according to the teachings of the present invention;

FIG. 13 illustrates a block diagram of another embodiment of a method according to the teachings of the present invention;

FIG. 14 illustrates a block diagram of another embodiment of a method according to the teachings of the present invention; and FIG. 15 illustrates a block diagram of another embodiment of a method according to the teachings of the present invention.

DETAILED DESCRIPTION OF THE INVENTION

Figure 1:
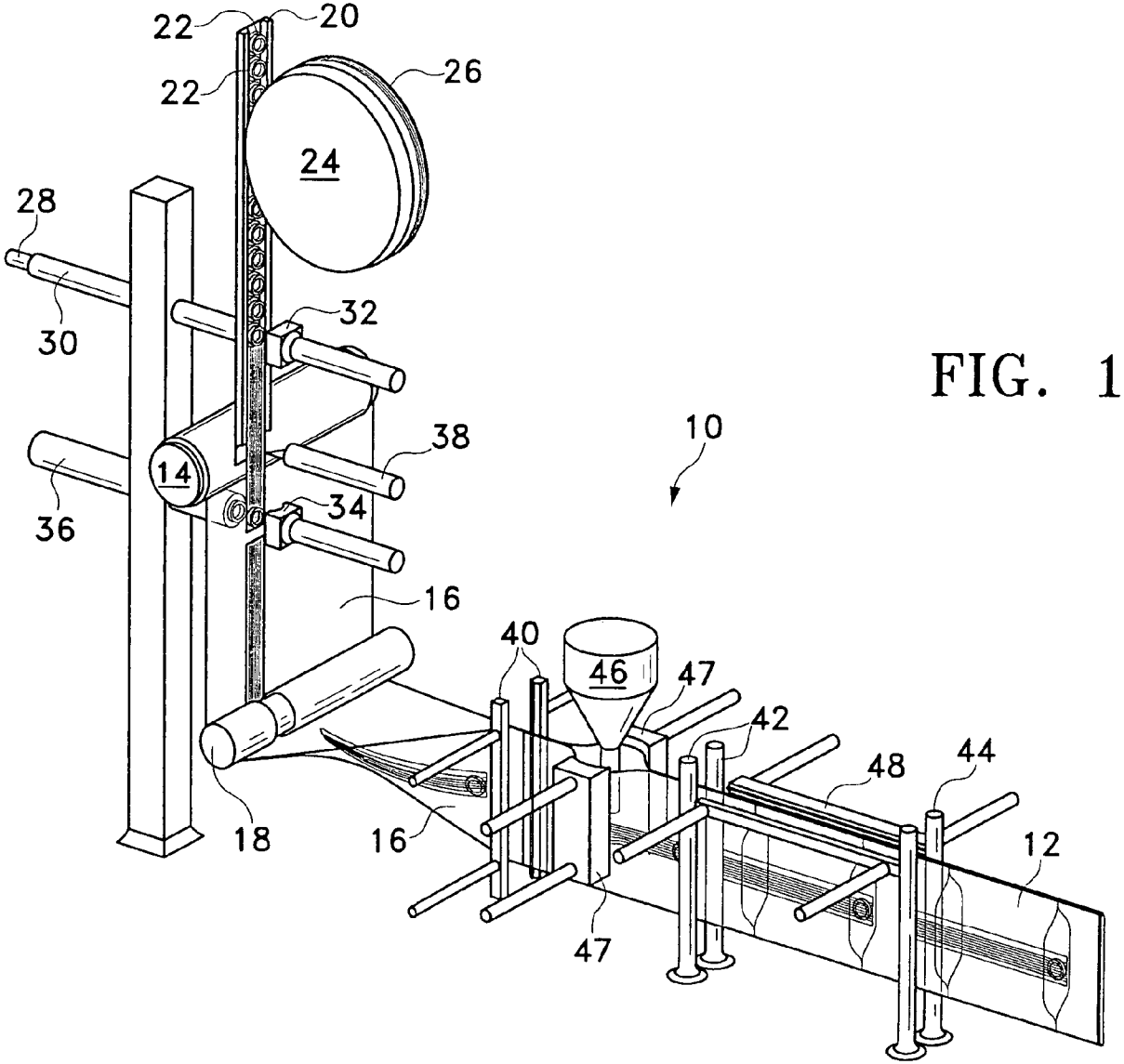
FIG. 1 illustrates a particular embodiment of a horizontal form, fill, and seal machine, and resulting bag, according to the teachings of the present invention.

The horizontal form, fill, and seal machine 10 shown in FIG. 1 illustrates a particular embodiment of the present invention, wherein an internal fitment is provided against which an external fitment can be pressed, for mating with the internal fitment and piercing the bag for evacuation of the product. Other embodiments that do not require such fitments, but which are made with fitments that provide a passageway through the bag wall, will be discussed in connection with other FIGURES.

The form, fill, and seal machine 10 of FIG. 1 is a horizontal type machine, and creates filled bags 12. A roll 14 provides a supply of bag material 16 that is used to form the bags of the present invention. The bag material 16 may comprise any material suitable for flexible packaging, such as, without limitation, single or multi-layer plastics, and other materials, such as foils. The bag material 16 is often called a sheet or web of material.

The plastic material 16 is rolled across a roller 18 and then folded (for example with a collar) to prepare for seaming and filling. Before roller 18, however, a supply of fitments 20 are advanced along a guide 22. Also, a roll 24 of evacuation devices 26 is provided for supplying an evacuation device for each bag. Preferably the roll 24 of evacuation devices 26 is a continuous roll, thus allowing the evacuation devices 26 to be efficiently manufactured as one extrusion (and cut into individual devices for each bag). However, no such roll is needed, and other approaches may be used, such as, without limitation, supplying separated evacuation devices, or using rolls of evacuation devices that include periodic features (such as thin areas for facilitating seaming in to seams).

In the particular embodiment shown in FIG. 1, internal fitments 20 and evacuation devices 26 are combined for being attached to the bag material 16. In particular, a positioning pin 28 moves horizontally within guide rail and press 30 to position each fitment 20. The evacuation devices 26 are fed into the guide 22 and heat-sealed to fitments 20 with heat sealer (weldhead) 32 pressing against the guide rail and press 30. Although heat sealing is preferable, other ways of attaching the evacuation devices 26 to the internal fitments 20 may be used without departing from the intended scope of the present invention. Furthermore, they may also be combined in a process separate from the machine, and indeed may be formed integrally during their manufacturing.

A combined evacuation device 26 and fitment 20 are advanced to the next station where they are attached to the bag material 16. This station includes heat sealer 34 and press 36. The bag material 16 and a combined internal fitment 20 and evacuation device 26 are passed between the heat sealer 34 and the press 36, and the heat sealer 34 presses the bag material 16 and fitment 20 together against press 36 and heat seals them together. A cutter 38 is provided for cutting the evacuation device 26 so as to separate the appropriate length for each bag. The cutter 38 cuts the material against a stop, which may be part of the guide 22, or any other suitable stop.

As can be seen in FIG. 1, the bag material 16 with attached fitment 20 and evacuation device 26 is folded after roller 18 to prepare for filling. The first side seal for each bag is made with sealer 40, by pressing the two folds (bag walls) of the bag material 16 against each other and heat-sealing them. The bag material 16 is then advanced the length of one bag, and sealing station 40 seals the second side seal (which is on the opposite side from the first seal) to form a bag that is folded on the bottom, seamed on each side, and still open at the top. At this point, the first side seal, which had been made on sealer 40, has been advanced to the general position 42 shown in FIG. 1.

The bag is filled through filler 46 (which may move up and down as each bag is advanced) with the appropriate product. The bag may be widened, to facilitate filling, with vacuum separators 47. After filling, the bag material 16 is advanced to the next station where top sealer 48 seals the top seam, such as with a heat-sealing press, to complete formation of the bag. The bag is then cut at support and cut station 44 and then handled for commercial distribution. For example, without limitation, a conveyer may be positioned to take the bag, after it is cut, to a station for inserting bags into boxes, for BIB-type systems.

Figure 2A:
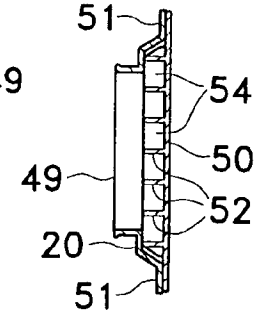
FIG. 2A illustrates a cross section of the combined evacuation device and internal fitment of FIG. 2, taken along line 2A of FIG. 2.
Figure 2:
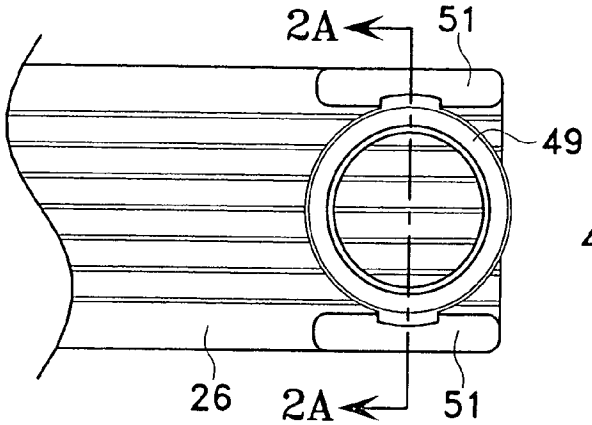
FIG. 2 illustrates a particular embodiment of a combined evacuation device and internal fitment according to the teachings of the present invention.

FIG. 2 illustrates a particular embodiment of an evacuation device 26 combined with an internal fitment 20. In the particular embodiment shown, the fitment 20 is welded to the evacuation device 26 at tabs 51 of the fitment 20. The particular embodiment discussed in connection with FIG. 1 uses an internal fitment 20, which, in the illustrated embodiment, has a section 49 across which the bag material 16 passes and onto which the bag material 16 is sealed. In use, a user attaches an external fitment that couples to the internal fitment 20 through the bag material 16 and pierces the bag material 16 to allow access to the product within the bag 12. The evacuation device 26, in a particular embodiment, is a strip of material referred to as a dip strip, which includes a base 50 and a plurality of ribs 52. The ribs 52 are relatively rigid, and provide evacuation channels 54 between them, which allow product to flow to the fitment 20 and out of the bag 12. Without the evacuation device 26, the bag material 16 has a tendency to seal against the fitment 20 during evacuation, thus blocking evacuation of the bag 12.

Figure 3:
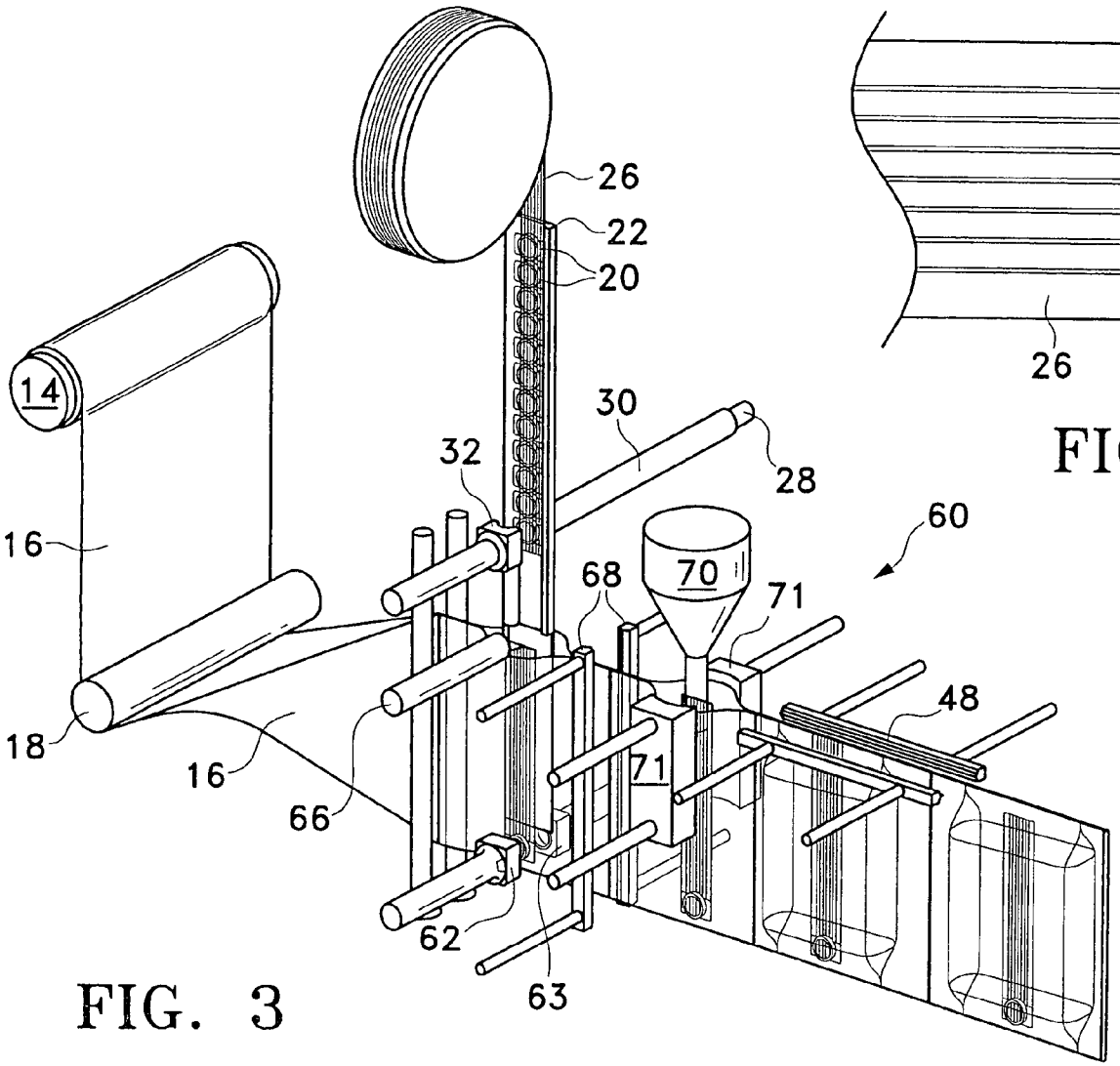
FIG. 3 illustrates another embodiment of a horizontal form, fill, and seal machine, and resulting bag, according to the teachings of the present invention.

Although the particular evacuation device 26 shown in FIG. 2 is a dip strip-type evacuation device, any other evacuation device may be used (with any embodiment or FIG. described herein) without departing from the intended scope of the present invention. Evacuation devices include any device intended to improve evacuation efficiencies. For example, without limitation, devices such as meshes, pillowed plastics, and other devices may be used as well. Also, the evacuation device may be an integral part of a fitment (such as without limitation, raised ribs on the base of the fitment). Thus, attaching evacuation devices includes, without limitation, attaching fitments that have features for improving evacuation efficiencies (even where no separate evacuation device is used) or attaching evacuation devices that may be joined to, combined with, or separate from fitments FIG. 3 illustrates another embodiment of a horizontal form, fill, and seal machine according to the teachings of the present invention. Form, fill, and seal machine 60 is similar to that of FIG. 1, in that internal fitments 20 and evacuation devices 26 are combined before being attached to the bag wall material 16. However, in the embodiment shown in FIG. 3, the internal fitments 20 and evacuation devices 26 are attached to the bag wall 16 after it has been folded after roll 18. As shown, the fitments 20 and evacuation devices 26 are combined in a guide 22 with heat sealer 32 sealing them together against guide rail and press 30, as discussed above in connection with FIG. 1. However, in the embodiment of FIG. 3, the heat sealing to the bag wall 16 occurs with heat sealer 62 sealing the bag wall 16 to the internal fitment 20 against press 63. A blade 66 cuts the evacuation devices 26 against the guide 22 or other stop.

Heat seal station 68 operates to form the side seals of the bag formed with the embodiment shown in FIG. 3. After the first side seal of a bag is formed at heat seal station 68, the bag material 16 is advanced so that heat sealing station 68 then forms the second side seal, creating a bag that is formed except that it has an open top. Then, product is filled into the bag through filler 70, as discussed above in connection with FIG. 1. The open top of the bag material may be widened for filling with vacuum separators 71. The filled bag is then advanced for top sealing, cutting, and handling as discussed above in the connection with FIG. 1.

Figure 4:
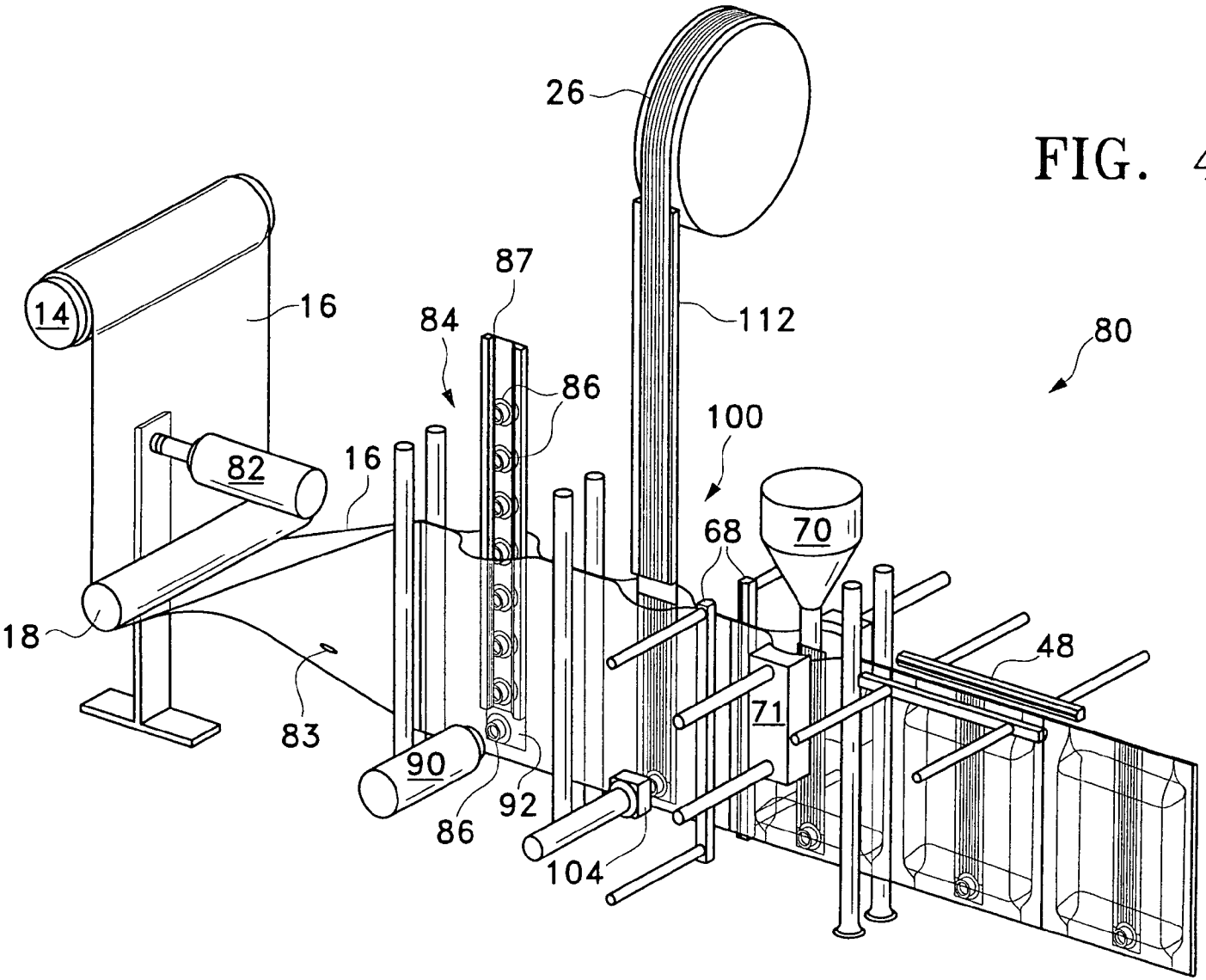
FIG. 4 illustrates another embodiment of a horizontal form, fill, and seal machine, and resulting bag, according to the teachings of the present invention.

FIG. 4 illustrates another embodiment of the present invention in which a horizontal form, fill, and seal machine 80 is used to make and fill bags that include fitments that pass through the bag wall so as to eliminate the need for any piercing or other coupling to an internal fitment at the time of use. In particular, holes for the fitments are made in the bag wall by a hole punch station 82. An exemplary hole 83 is shown. Preferably a system is used that collects the plugs that are made when the hole is punched, so as to keep the plugs out of the bags. In particular, a vacuum system or other suitable system may be used for this purpose. The bag material 16 is folded after roller 18 and advanced to a fitment attachment station 84. Hole punch station 82 may be positioned before or after the bag folding. A particular embodiment of fitment attachment station 84 is shown more particularly in FIG. 5. As shown in FIG. 5, a fitment 86 (fitments 86 are supplied by a guide 87) is inserted through the bag hole formed at hole punch station 82. The fitment 86 includes a flange 88 (or any other suitable part) that extends outward from the base of the fitment. The flange 88 is heat sealed to the bag material 16 by heat sealer 90 pressing against stop 92.

Next, the web of bag material 16 is advanced to evacuation device attachment station 100. Here, the evacuation devices 26 are advanced along guide 112 between the folds of bag material 16 and heat-sealed in place. In a particular embodiment, each evacuation device 26 is heat sealed to a fitment 86, as is shown in FIG. 6. The evacuation device 26 is advanced between heat sealer 102 and stop 104. Stop 104 is shaped so as to surround the exterior portion of fitment 86. Also shown in FIG. 6 is cutter 106. Cutter 106 is used to cut the evacuation device material 26 for each bag (and may cut from the front or the back side). The blade 108 of cutter 106 cuts against guide mechanism 112 or other stop. Vacuum separators, such as those discussed above, or guides may be used to widen the space between the bag material folds to facilitate the various stations, such as stations 84 and 100.

It should be understood that attaching the evacuation device 26 to the fitment 86 is exemplary only, and the evacuation device 26 may also be attached, without limitation, to the bag material 16 itself, in one or more places, such as by tacking with heat sealing, and may be attached to the bag wall 16 alone or in combination with attaching it to the fitment 86, or may be seamed into the top seam (with or without other attachments). Furthermore, the cutting mechanism shown in FIG. 6 is exemplary only, and any cutting mechanism (or pre-made individual evacuation devices for each bag) may be used without departing from the intended scope of the present invention. After the fitment 86 and evacuation device 26 are attached, the bag is advanced to sealing station 68 and then further filled, cut, and handled as discussed above in connection with FIG. 3 and the other descriptions.

It should also be understood that the particular approach shown for attaching the fitment 86 is exemplary only, and other approaches may be used without departing from the intended scope of the present invention. In particular, the following US patents provide examples of particular ways of attaching a fitment to a web of film (although other approaches may also be used), and are herein incorporated by reference in their entirety; U.S. Pat. No. 5,203,819 entitled Apparatus For Attaching A Fitment To A Web of Film; U.S. Pat. No. 4,779,397, entitled Apparatus and Method for Attaching A Fitment to a Web of Film; U.S. Pat. No. 4,512,136, entitled Fitment Attachment Methods in Horizontal Form/Fill/Seal Machines; U.S. Pat. No. 4,718,215, entitled Apparatus and Method for Attaching Fitments to Flexible Containers; U.S. Pat. No. 4,246,062, entitled Apparatus for Attaching a Fitment to a Pouch; and U.S. Pat. No. 4,695,337, entitled Apparatus and Method for Attaching a Fitment to a Web of Film. These examples apply both to the horizontal form, fill, and seal apparatus discussed herein, and to the vertical form, fill, and seal apparatus to be discussed below.

Furthermore, the particular fitment 86 shown in FIG. 3 is exemplary only, and other fitments may be included as well. Indeed, throughout this description, the term fitment is used to describe any device that allows or facilitates the transfer of product from inside a flexible bag to the outside of the flexible bag. For example, fitments include spouts, valves, ports, bases such as that described in connection with FIG. 1 that allow an external piercing mechanisms to couple to them to allow access, and single or multiple-piece parts, among others. A particular example of a fitment that includes a valve, and which is suitable for use in the beverage syrup industry, is described in U.S. Pat. No. 5,477,883, entitled Self-Sealing Bag Valve, which is herein incorporated by reference in its entirety. However, with the present invention, such a fitment and valve may be made (although need not be) without the need for the valve to be removable (which is required where the a bag is filled through the fitment), because the bag is not filled through the fitment in the present invention. In the context of the present invention, if a fitment is used that includes a removable valve or other removable part (such as, without limitation, a cap), the removable part may be in place when the fitment is attached to the bag, or another step may be added to couple the removable part to the attached fitment.

Also, with the horizontal apparatus discussed above, it is preferred that the bag walls be formed by folding one sheet of bag material. However, two sheets may be brought together and sealed without departing from the intended scope of the present invention.

As discussed above in connection with fitment 20, the evacuation device 26 significantly increases evacuation efficiency with fitment 86 (or any fitment) by providing evacuation channels for the product to flow through, and preventing the bag walls from closing flow through the fitment during evacuation.

It should also be understood that pass-through fitments, such as though discussed in connection with FIG. 4, may be combined with evacuation devices before being attached to the bag material (for example, without limitation, similar to the approach shown in FIG. 3). In such case, a station such as station 100 need not be used. Also, internal fitments, such as fitments 20 discussed above, may be attached separately from the evacuation devices.

Figure 7:
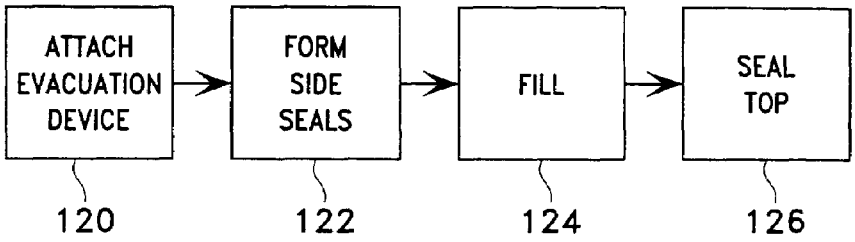
FIG. 7 illustrates a block diagram of a particular embodiment of a method according to the teachings of the present invention.

FIG. 7 illustrates a block diagram of a particular embodiment of a method according to the teachings of the present invention. As shown in FIG. 7, at block 120 an evacuation device is attached to bag material, directly or indirectly (for example, without limitation, to a fitment, to the bag, seamed into side or top seams, or any combination thereof). It may be attached before or after the bag material is folded or a bag is otherwise partially formed. At block 122, side seals are formed. At block 124, product is filled through the open top of the partially formed bag. Then, at block 126, the top of the bag is sealed, thereby completing the filling portion of the bag. The bag is then ready to be cut loose handled for distribution. In most cases, a fitment will also be used as part of the present invention; but, without limitation, one broad sense of the present invention includes merely attaching an evacuation device in connection with forming and filling a flexible package, whether or not a fitment is also used.

Figure 8:
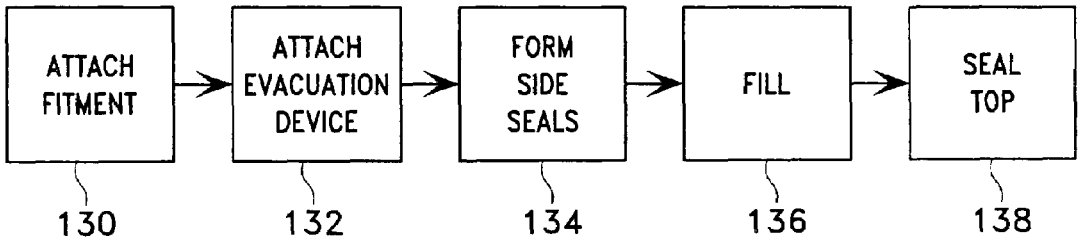
FIG. 8 illustrates a block diagram of another embodiment of a method according to the teachings of the present invention.

FIG. 8 illustrates another embodiment of the present invention, in which a fitment is attached to a web of bag material at block 130. At block 132, an evacuation device is attached. The attachment can occur, without limitation, to the bag material itself, to the fitment, to both, into seams, or any combination of these. At block 134, side seals are formed. Then, at block 136, product is filled into the partially formed bag. At block 138, the top of the bag is sealed, and the bag is then ready to be cut and handled for distribution.

Although the present invention encompasses attaching the evacuation device anywhere within the bag, it is preferred that the evacuation device be positioned in such a way that it is in relatively close proximity to the fitment through which product will be accessed. This close proximity helps insure that the web of bag material will not seal off the fitment through which product is accessed during evacuation of the bag.

Figure 9:
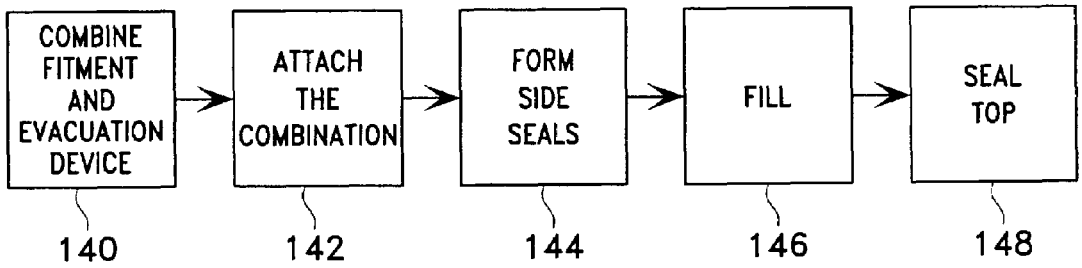
FIG. 9 illustrates a block diagram of another embodiment of a method according to the teachings of the present invention.

FIG. 9 illustrates another embodiment of a method according to the teachings of the present invention. As shown in FIG. 9, a fitment and evacuation device are combined at block 140. At block 142, the combined fitment and evacuation device are attached to a web of bag material. The attachment may occur either before or after the bag material is folded or the bag is otherwise partially formed. At step 144, side seals are formed, and at block 146 product is filled in to the open top of the partially formed bag. At step 148, the open top is sealed. The bag is then ready for cutting loose and distribution.

Figure 10:
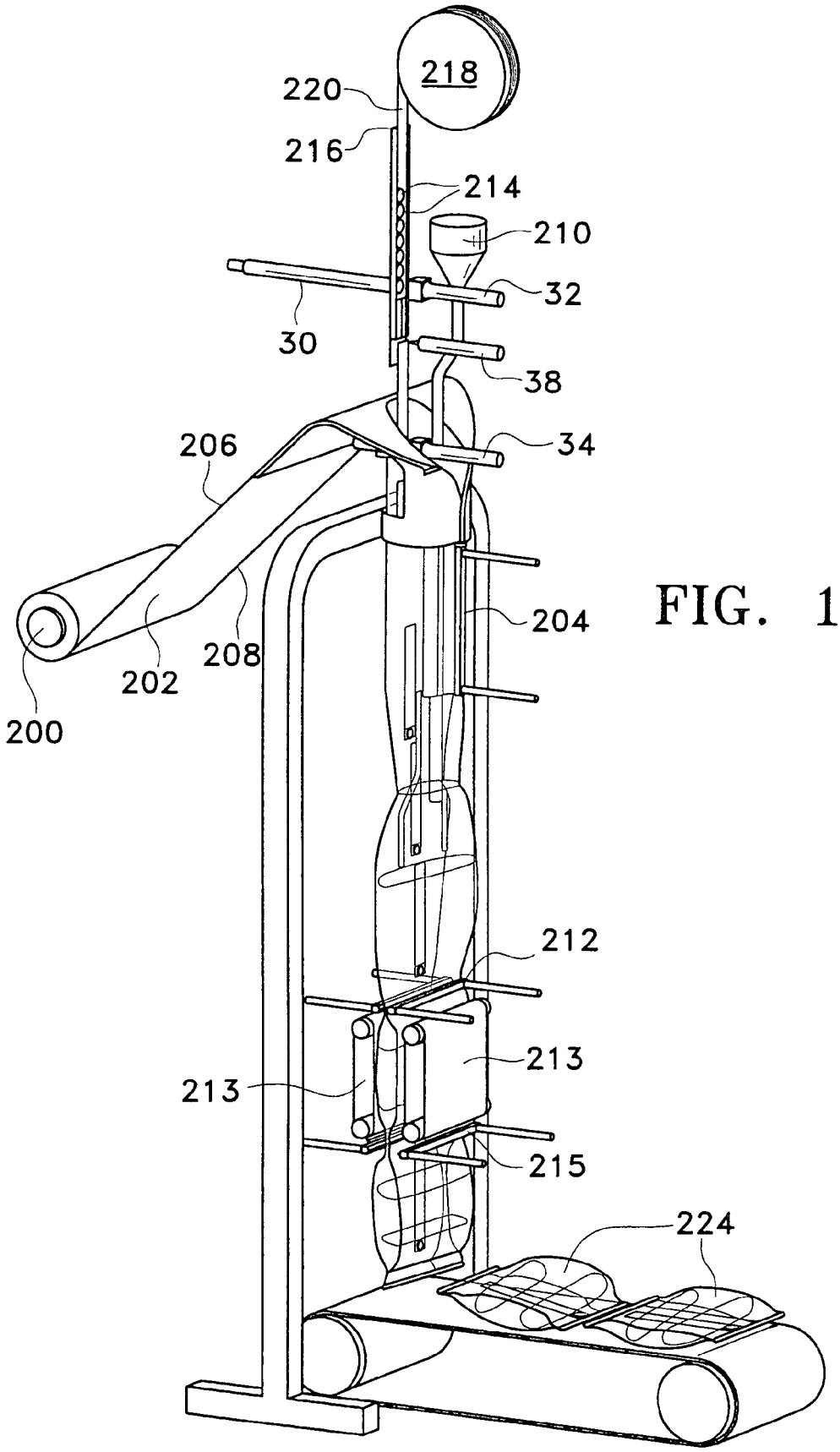
FIG. 10 illustrates a particular embodiment of a vertical form, fill, and seal machine, and resulting bag, according to the teachings of the present invention.

FIG. 10 illustrates another embodiment of the present invention in which fitments and evacuation devices are attached to a bag on a vertical form, fill, and seal machine. As shown in FIG. 10, a roll 200 of bag material 202 is provided to supply a vertical form, fill, and seal machine. The bag material 202 is formed (for example with a collar and guide) into a generally tubular shape (tubular is meant to indicate a shape is formed that has an open top and open bottom, and need not have a round or oval cross-sectional shape). Indeed, any cross-sectional shape may be used. To seal the tubular shape, heat sealer 204 is used to seal the bag material 202 near or at its ends 206 and 208 after they are overlapped, thus creating a partially formed bag that is open at the top and the bottom. A filler 210 is used to fill product into the bags. The product is filled through filler 210 after a bottom seal of a bag is formed by heat sealer 212. Heat sealer 212 also serves to create a top seal of an already filled bag. Roller guides 213 support and shape the bags during filling and top sealing, and allow most air to be expelled from the bag before sealing. (Guides such as these may also be used on the horizontal embodiments in connection with top sealing.) The bags are cut free for further distribution by a cutter 215. A supply of fitments 214 is provided on guide 216 into the tubular structure, and evacuation devices 220 are supplied from a roll 218.

As discussed above in connection with the horizontal form, fill, and seal machines, the fitments 214 and evacuation devices 220 may be combined and attached to the bag material 202, or separately attached, and may be attached before or after the bag material is formed into a "tube" and before or after any seals are made. Also, any kind of fitment may be used, including, without limitation, internal fitments such as fitments 20, or pass-through fitments such as fitments 86 discussed above. The particular devices for accomplishing this attachment are similar to those discussed above in connection with the other embodiments (such as the devices discussed above in connection with FIGS. 1-6), and thus may be used with the vertical machine embodiment. Without limitation, the particular example shown in FIG. 10 shows the pre-combining approach such as that discussed in FIG. 1, with heat sealer 32 combining the evacuation devices 220 with fitments 214. Cutter 38 cuts the evacuation device, and heat sealer 34 attaches the combination to the bag material 206 against a stop. Completed bags 224 are shown in FIG. 10.

FIGS. 11-13 illustrate particular embodiments of methods according to the teaching of the present invention that are most suited for use with vertical form, fill, and seal processes. As shown in FIG. 11 a "tube" of bag material is formed at block 230. At block 232, an evacuation device is attached (directly or indirectly) to the bag material. At block 234, a bottom seal is created, thus forming a bag with a bottom seal, a tube-like structure, and an open top. At block 236, product is filled to this partially formed bag, and at block 238, the top of the bag is sealed. In a particular embodiment, the top sealing occurs after advancing the partially filled bag so that the top seal of the filled bag is formed at the same time and by the same mechanism as the bottom seal of the next-to-be filled bag. Also, step 238, the bag is cut free for distribution. In most cases, a fitment will also be used as part of the present invention; but, without limitation, one broad sense of the present invention includes merely attaching an evacuation device in connection with forming and filling a flexible package, whether or not a fitment is also used.

FIG. 12 illustrates another embodiment in which a "tube" structure is formed from bag material to make a partially formed bag at block 240. At block 242, a fitment is attached to the bag material. At block 244, an evacuation device is attached to the bag material (directly or indirectly), for example by attaching it to the fitment, or to the bag material, or to both. At block 246, a bottom seal is made to create a partially formed bag ready for filling. At block 248, product is filled into the partially formed bag, which is then advanced for top sealing at block 250. As discussed above, the top-sealing station may be the same as the bottom-sealing station used at block 246, although this is not necessary. After sealing the top, the bag is then separated for distribution.

FIG. 13 illustrates another embodiment of the present invention in which a tube of bag material is formed at block 260. At block 262, a combined fitment and evacuation device is attached to the bag material. The fitment and evacuation device have been previously combined (by the same machine or a different one than is used for forming and filling bags) in this embodiment. At block 264, a bottom seal is made to create a partially formed bag ready for filling, which filling occurs at block 266. After filling at block 266, a top seal is created at block 268 and the bag is then cut and is ready for distribution.

FIG. 14 illustrates another embodiment of the present invention in which an evacuation device is seamed into the bottom seam at block 270. Then, at block 272 the partially formed bag is filled and then advanced so that the top seam can be made at block 274. Also at block 274, the evacuation device is seamed into the top seam and cut. Thus, in this particular embodiment, no separate mechanism is needed for sealing the evacuation device to the fitment or to the bag material, although such sealing may be done in combination with this method, if desired. Furthermore, as discussed above, it is preferable that the evacuation device be in close proximity to the fitment to provide higher evacuation efficiencies. Also, it should be recognized that, as discussed above, the top and bottom seaming may be accomplished on the same station with the same physical devices, and thus the bottom sealing of one bag is performed with the top sealing of another bag, and the cutting of the evacuation device. However, in all embodiments, these tasks may be performed separately or together. Also, the method of FIG. 14 may be used on a horizontal system, wherein the evacuation device is seamed into one or both side seals, or into the top seal.

FIG. 15 illustrates another method according to the teachings of the present invention in which an evacuation device is inserted into a partially formed bag at block 280. At block 282, the evacuation device is attached in some way, directly or indirectly, to the partially formed bag. At block 284, the partially formed bag is filled with product and then sealed at block 286. The sealed bag is ready to be cut loose for distribution.

Throughout the description of the methods of the present invention, it should be understood that, where appropriate, the order of the process may be changed without departing form the intended scope of the present invention. For example, in the vertical embodiments, the fitments and evacuation devices may be attached to the bag material before or after the "tube" structure is formed, and before or after any seals (such as bottom seals) are made. Similarly, for the horizontal embodiments, such attaching may occur before or after folding (or the like), and before or after any seals (such as side seals) are made. Also, it should be understood that any fitment type can be used with each embodiment, including, without limitation, internal type fitments or pass-through type fitments.

The particular descriptions provided are illustrative examples, and features and advantages of each example may be interchanged with, or added to the features and advantages in the other embodiments and examples herein. And, in general, although the present invention has been described in detail, it should be understood that various changes, alterations, substitutions, additions and modifications can be made without departing from the intended scope of the invention, as defined in the following claims.

What is claimed is:

1. A system for forming, filling, and sealing a package, comprising:

a source of flexible material, the flexible material comprising a first end and a second end;

a forming guide operable to direct the flexible material into a form comprising an open top and an open bottom, and wherein the first and second ends overlap to form an overlapping portion;

a first sealing mechanism operable to seal at least part of the overlapping portion;

a source of liquid product;

a fitment comprising a passageway through which at least some of the liquid product may pass during evacuation of the package fitment adapted to be coupled to a pump for evacuation of the package;

a fitment attaching mechanism operable to attach fitment to the flexible material;

an evacuation device adapted to facilitate flow of at least some of the liquid product to the fitment by effectively preventing the flexible material from closing off flow to the fitment during evacuation of the package, the evacuation device comprising a first evacuation device end and a terminal end with a length between the first evacuation device end and the terminal end, wherein the evacuation device comprises a channel directly open to the liquid product at intermediate locations substantially the entire length between the first evacuation device end and the terminal end, such that liquid product may enter the channel at the intermediate locations;

an evacuation device attaching mechanism operable to attach the evacuation device proximate the fitment, wherein the evacuation device attaching mechanism attaches the evacuation device to the flexible material;

a second sealing mechanism operable to seal the bottom and top of the form; and a filler operable to fill liquid product into the form through the open top of the form, after the bottom of the form is sealed, after the fitment is attached, and before the top of the form is sealed.

2. A system for forming, filling, and sealing a package, comprising:

a source of flexible material, the flexible material comprising a first end and a second end;

a forming guide operable to direct the flexible material into a form comprising an open top and an open bottom, and wherein the first and second ends overlap to form an overlapping portion;

a first sealing mechanism operable to seal at least part of the overlapping portion;

a source of liquid product;

a fitment comprising a passageway through which at least some of the liquid product may pass during evacuation of the package, the fitment adapted to be coupled to a pump for evacuation of the package;

a self-sealing valve coupled to the fitment wherein the self-sealing valve is formed integrally with the fitment;

a fitment attaching mechanism operable to attach the fitment to the flexible material;

an evacuation device adapted to facilitate flow of at least some of the liquid product to the fitment by effectively preventing the flexible material from closing off flow to the fitment during evacuation of the package, the evacuation device comprising a first evacuation device end and a terminal end with a length between the first evacuation device end and the terminal end, wherein the evacuation device comprises a channel directly open to the liquid product at intermediate locations substantially the entire length between the first evacuation device end and the terminal end, such that liquid product may enter the channel at the intermediate locations;

an evacuation device attaching mechanism operable to attach the evacuation device proximate the fitment;

a second sealing mechanism operable to seal the bottom and top of the form; and a filler operable to fill liquid product into the form through the open top of the form, after the bottom of the form is sealed, after the fitment is attached. and before the top of the form is sealed.

* * * * *